United States Patent [19]

Goins

[11] 4,003,433

[45] Jan. 18, 1977

[54] METHOD FOR CUTTING PIPE

[76] Inventor: Mack Goins, 577 Contour Dr., Lake Charles, La. 70601

[22] Filed: May 12, 1975

[21] Appl. No.: 576,727

Related U.S. Application Data

[62] Division of Ser. No. 521,473, Nov. 6, 1974, Pat. No. 3,902,070.

[52] U.S. Cl. ..... 166/298; 166/55.8

[51] Int. Cl.[2] ..... E21B 29/00

[58] Field of Search ..... 166/298, 55.1, 55, 55.8, 166/55.2, 55.3, 55.6, 55.7, 297, 298, 297

[56] References Cited

UNITED STATES PATENTS

| | | | |
|---|---|---|---|
| 935,467 | 9/1909 | Cushing | 166/55.7 |
| 1,104,492 | 7/1914 | Greve | 166/55.7 |
| 1,460,894 | 7/1923 | Dix | 166/55.7 |
| 1,643,709 | 9/1927 | Fawcett | 166/55.7 |
| 1,756,128 | 4/1930 | Monroe | 166/55.7 |
| 2,188,409 | 1/1940 | Lane | 166/55.7 |
| 2,622,679 | 12/1952 | Ransom | 166/55.7 |

*Primary Examiner*—Ernest R. Purser
*Assistant Examiner*—Richard E. Favreau
*Attorney, Agent, or Firm*—LeBlanc & Shur

[57] ABSTRACT

Method of cutting pipe using a pipe cutter including annular, axially aligned, gear, grip and cutter sections and a central shaft within the sections. The shaft is geared to the gear section for rotation in response to axial upward movement of the shaft relative to the gear section. The grip section carries pivoted jaws which are cammed outwardly by an enlarged diameter portion of the shaft in response to axial upward movement of the shaft relative to the gear, grip and cutter sections. The cutter section is journalled to the lower end of the grip section and carries a plurality of pivoted cutting blades movable laterally outwardly into engagement with the inner wall of the pipe casing in response to axial upward movement of the shaft. The cutter section is also splined to the shaft for rotation therewith. A cylinder is carried at the upper end of the gear section and the upper end of the shaft carries a piston in the cylinder. Upward movement of the piston within the cylinder by ignition of a power charge cams the jaws laterally outwardly to grip the interior pipe wall and causes rotation of the shaft relative to the gear section. Upward movement of the shaft also cams the cutting blades laterally outwardly and rotates such blades to cut the pipe. At the end of the upward stroke of the shaft, a reduced diameter shaft portion backs the jaws enabling such jaws to pivot laterally inwardly to release the cutter from the pipe wall. The lower end of the shaft is also located above the cutter blades enabling the blades to retract within the cutter section.

7 Claims, 12 Drawing Figures

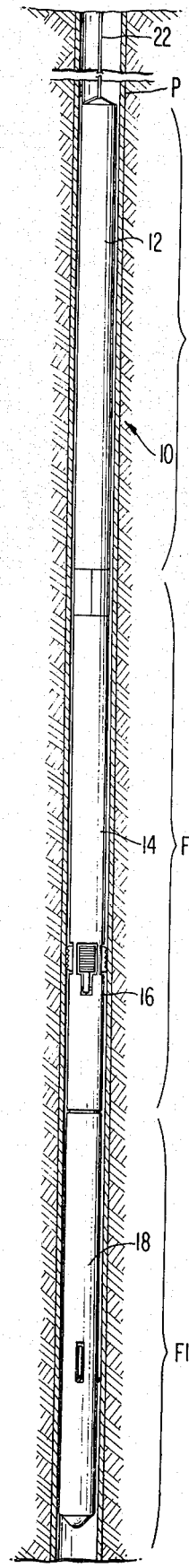
FIG.1
22
P
12
FIG.2
10
14
FIG.3
16
18
FIG.4
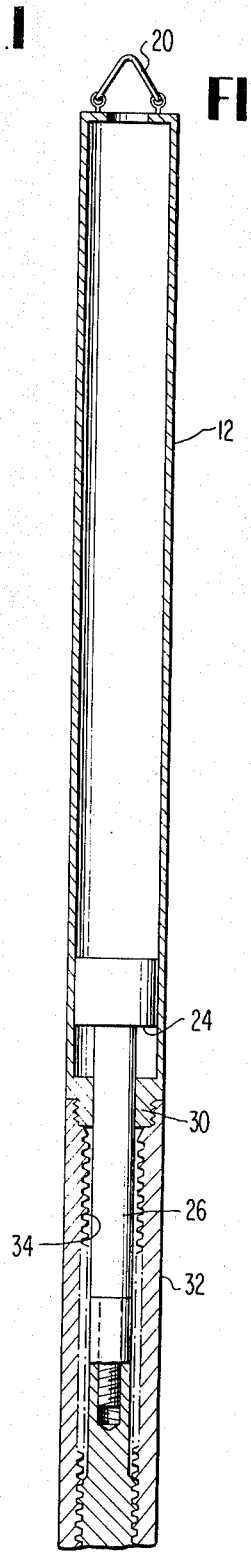
FIG.2
20
12
24
30
26
34
32
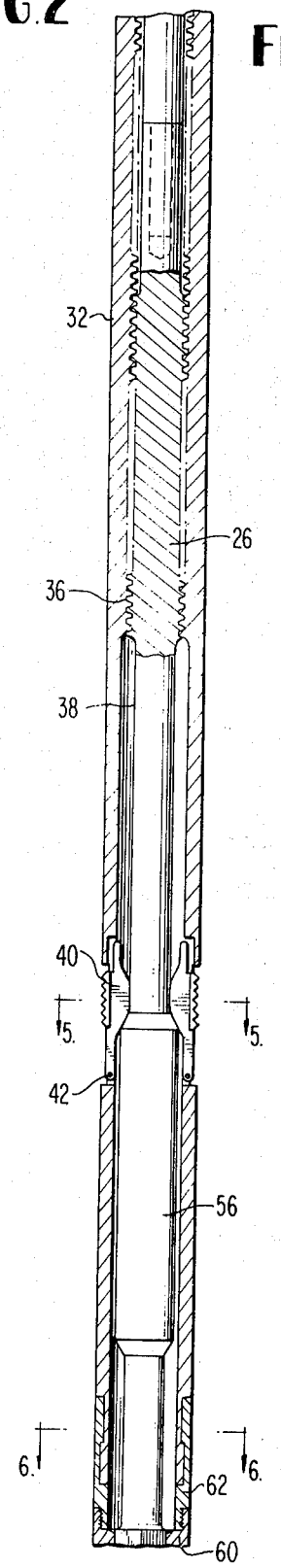
FIG.3
32
26
36
38
40
5.
5.
42
56
6.
6.
62
60
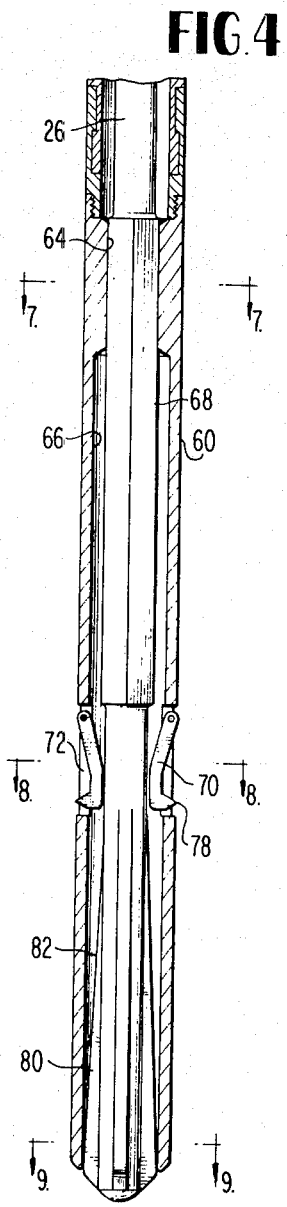
FIG.4
26
64
7.
7.
68
66
60
72
8.
70
8.
78
82
80
9.
9.

FIG. 5
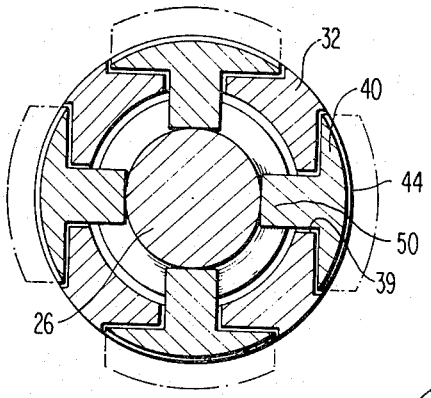
FIG. 6
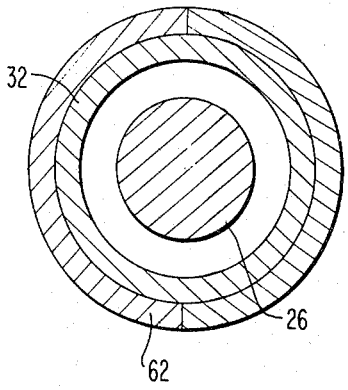
FIG. 7
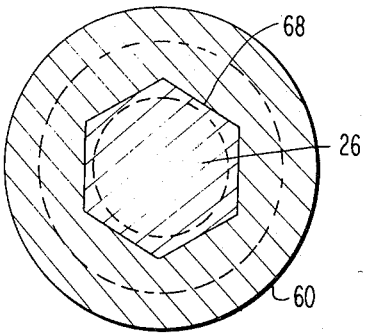
FIG. 8
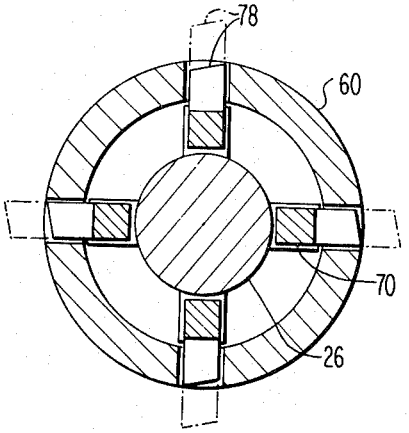
FIG. 2a
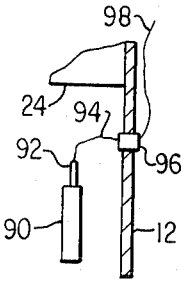
FIG. 9
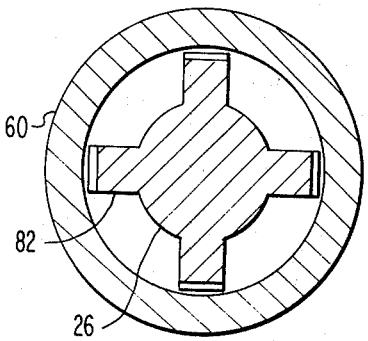
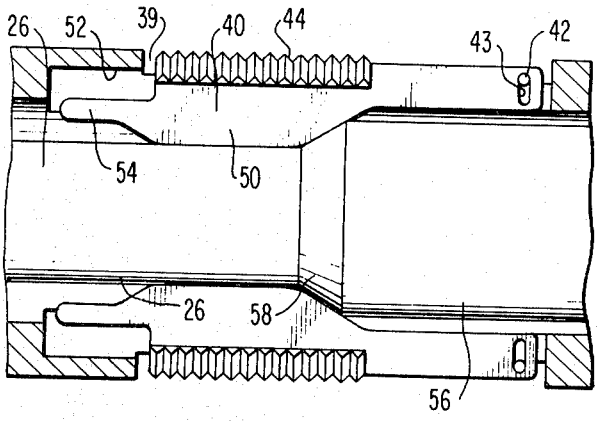
FIG. 11
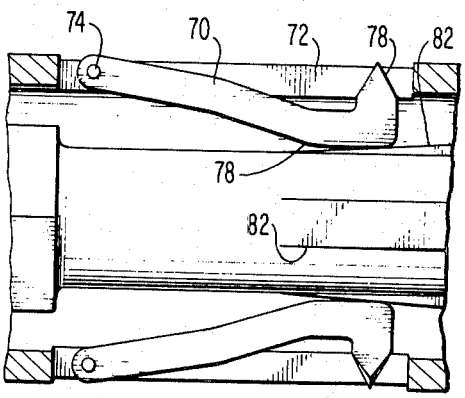
FIG. 10

METHOD FOR CUTTING PIPE

This is a division of application Ser. No. 521,473, filed Nov. 6, 1974, now U.S. Pat. No. 3,902,070, issued Nov. 18, 1975.

The present invention relates to apparatus and methods for cutting pipe and particularly relates to apparatus and methods for cutting pipe internally from a remote position, for example cutting well casing pipe.

Many and various prior apparatus and methods have been proposed for cutting pipe internally and a great deal of interest today is being focused on the recovery of pipe from unused or exhausted wells in view of the present shortage and high cost of pipe. Such prior methods have included using a dynamite cutter for cutting the pipe in the well. However, this method has a number of disadvantages including the possible fracture of geological formations and other adverse environmental effects. Cutters using a chemical action to cut pipe into sections have been proposed and utilized but these are effective only about one-half the time. Mechanical type cutters carried by an assembled string of pipe have also been used. These, however, involve a great deal of time and expense since the pipe must first be assembled to the required length and later disassembled after cutting the pipe casing. Pipe cutters hung within the well casing from cables have also been proposed. Examples of these types of pipe cutters are disclosed in U.S. Pat. Nos. 2,622,679 and 1,643,709. In the former patent, jaws are carried by the cutter for engagement with the inner wall of the pipe in response to a slight upward pull on the cable supporting the cutter in the well casing. A reciprocating action provided the cable and a weight forming part of the cutter is necessary to gradually laterally extend the cutting teeth into cutting engagement with the pipe casing. The latter mentioned patent also utilizes an upward pull on the cable suspending the cutter in the pipe casing to rotate the cutter head. The manner in which these cutters are set in the pipe casing and by which the cutter blades are rotated requires considerable time and effort to effect the cut. Additionally, such mechanisms are cumbersome, are comprised of a large number of parts, and are therefore expensive to manufacture.

The present invention provides a pipe cutter which eliminates or minimizes the foregoing and other problems associated with prior pipe cutting apparatus and methods and provides novel and improved apparatus and methods for cutting pipe internally having various advantages in construction, mode of operation and result in comparison with such prior pipe cutting apparatus and methods. Particularly, the present invention provides a pipe cutter which engages the pipe wall to fix the cutter within the pipe and cuts the pipe in response to a single axial stroke of a shaft in one direction. More particularly, the pipe cutter hereof includes annular, axially aligned, gear, grip and cutter sections and in which a coaxial shaft is received. The upper end of the shaft carries a piston disposed within a cylinder located at the upper end of the gear section, the cylinder having a hanger support at its upper end whereby the pipe cutter can be raised from and lowered into a well casing by a cable. Portions of the shaft and gear sections are geared one to the other whereby the shaft rotates relative to the gear section after the cutter is fixed to the well casing and in response to upward axial displacement of the shaft relative to the gear, grip and cutter sections. To fix the cutter to the interior wall of the pipe, a plurality of circumferentially spaced pivoted jaws are carried by the grip section and which jaws pivot in response to axially upward movement of the shaft from retracted positions within the cylindrical confines of the grip section radially outwardly to engage the interior wall of the pipe section. The cutter section is coupled to the lower end of the grip section through a bearing whereby the cutter section is rotatable relative to the slip and gear sections. The cutter section and a portion of the shaft extending through the cutter section are splined one to the other such that the rotation of the shaft causes rotation of the cutter section. A plurality of cutter blades are pivotally carried by the cutter section and are cammed outwardly from a retracted position, in response to upward movement of the shaft into cutting engagement with the inner walls of the pipe.

When the pipe cutter is lowered into the well casing, and located at the desired depth, a power charge is ignited, the gas from which expands to drive the piston upwardly relative to the cylinder. Initial axial upward movement of the shaft causes an enlarged diameter portion of the shaft in the grip section to cam the jaws outwardly into engagement with the inner walls of the pipe. Upward movement of the shaft relative to the gear section also causes relative rotation therebetween which, when the jaws engage the pipe, causes rotation of the shaft relative to the fixed gear section. The shaft also rotates the cutter section through its splined engagement therewith. As the shaft rotates and is displaced upwardly, the tapered lower end of the shaft cams the cutter blades into engagement with the wall of the pipe and continued rotation of the cutting section and upward movement of the shaft causes the cutting edges to bear against the pipe wall with increasing pressure thereby cutting through the pipe. When the pipe is finally cut through, the enlarged diameter portion of the shaft in the grip section is displaced upwardly past the jaws enabling the jaws to pivot inwardly into their retracted positions thereby releasing the pipe cutter from engagement with the pipe. After the cut is completed, the lower end of the shaft is also displaced upwardly past the cutter blades whereupon the blades are spring retracted into their initial retracted position. After the pipe has been cut, the pipe cutter is thus returned to its cable suspended condition within the well casing and can be hauled upwardly out of the pipe by hauling in the cable and subsequently charged for making another cut.

Accordingly, it is the primary object of the present invention to provide a novel and improved apparatus and methods for internally cutting pipe.

It is another object of the present invention to provide novel and improved apparatus and methods for internally cutting pipe wherein the pipe cutter is suspended within a well casing by a cable.

It is still another object of the present invention to provide novel and improved apparatus and methods for internally cutting pipe in which the cutter substantially simultaneously grips and cuts the pipe in response to the movement of a single operative element.

It is a further object of the present invention to provide novel and improved apparatus and methods for cutting pipe internally and wherein the pipe cutter is formed of a relatively small number of inexpensive parts and which can be readily and easily assembled and utilized.

These and further objects and advantages of the present invention will become more apparent upon reference to the following specification, appended claims and drawings wherein:

FIG. 1 is a fragmentary side elevational view of a pipe cutter constructed in accordance with the present invention and illustrated as disposed in a well casing;

FIGS. 2, 3 and 4 are fragmentary enlarged vertical cross sectional views of respective upper, intermediate and lower portions of the pipe cutter illustrated in FIG. 1;

FIG. 2*a* is an enlarged fragmentary cross-sectional view of the upper portion of the pipe cutter illustrating the power charge and actuating wires therefor;

FIGS. 5, 6, 7, 8 and 9 are cross sectional views taken generally about on the corresponding numbered lines in FIGS. 3 and 4;

FIG. 10 is an enlarged fragmentary cross-sectional view of the grip section of the pipe cutter illustrating the gripping jaws in a retracted position; and FIG. 11 is a fragmentary enlarged cross sectional view of a portion of the cutter section and illustrating the cutter blades in a retracted position.

Referring now to the drawings, particularly to FIG. 1, there is illustrated a well bore containing a pipe casing designated P and which pipe casing is to be cut by the pipe cutter generally designated 10 hereof preparatory to removing the cut casing from the well bore. Particularly, the pipe cutter generally includes at its upper end a cylinder section 12, a gear section 14, a grip section 16, and a cutter section 18, all of which sections are in axial alignment one with the other with the cylinder section located at the top of the cutter and the cutting section located at the bottom thereof and the gear and grip sections intermediate such upper and lower sections. At the upper end of the cylinder section 12 there is provided a hanger support 20 for connection with a cable 22 whereby the pipe cutter 10 can be suspended within the casing in the well bore. The cylinder section 12 carries a piston head 24 which is located at the upper end of a shaft 26 and which shaft extends the length of the pipe cutter as illustrated and as will be apparent from the ensuing description. The shaft 26 passes through a suitable reduced diameter portion of the lower end of cylinder 12. The lower end of cylinder 12 is screwthreaded into the upper end of an annular sleeve 32 which forms a part of the gear and grip sections of pipe cutter 10. Sleeve 32 is internally threaded at 34 over a substantial portion of its length adjacent its upper end. A portion of the length of shaft 26 within sleeve 32 and in gear section 14 is externally threaded at 36 for threaded engagement with the internally threaded portions of sleeve 32. As illustrated in FIG. 3, shaft 26 has a reduced diameter portion 38 below the threaded portion 36 for reasons noted hereinafter.

Referring now to FIGS. 3, 5 and 11, grip section 16 includes a plurality of circumferentially spaced openings 39 in each of which is disposed a jaw 40. Jaws 40 are pivotally secured about pins 42 coupled to sleeve 32. It will be appreciated that the jaws 40 are thus circumferentially spaced about sleeve 32 and that three or four jaws are preferred, four jaws being illustrated. Each of jaws 40 is generally T-shaped in axial cross section and has an outer face 44 which is arcuate to conform to the arcuate or circular section of sleeve 32 when each jaw lies in its retracted position illustrated in FIGS. 5 and 10. The faces 44 are knurled or serrated to enhance gripping engagement with the inner wall of pipe casing P. Each jaw 40 includes a cam follower 50 along its inner or back surface and which follower projects within the bore of sleeve 32. The inner wall of sleeve 32 adjacent one end of each opening 39 is undercut at 52 to form a stop for a finger 54 which projects from the end of jaw 40 remote from its pivot pin 42. Consequently, from a review of FIG. 11, it will be appreciated that each jaw 40 is pivotal laterally outwardly about pin 42 from its illustrated retracted position to a projected position illustrated by the dashed lines in FIG. 5, such lateral outward movement being limited by finger 54 in engagement against stop 52. Each pin 42 is also received within an elongated radially extending slot 43 at the base of the corresponding jaw 40 whereby each jaw 40 is first pivotal outwardly about pin 42 and then pivoted about the opposite end of the jaw and translated such that the entirety of face 44 lies flush against the inside wall of pipe P and generally parallel to the long axis of the cutter. Also, any suitable type of retaining spring, not shown, may be utilized to bias each jaw 40 toward and retain it in its retracted position.

With reference to FIGS. 3 and 11, shaft 26 has an enlarged diameter portion 56 below the reduced diameter portion 38 and also below jaws 40. The shoulder 58 between the reduced and enlarged diameter portions 26 and 56, respectively, of shaft 26 forms a cam operable against the inside surfaces or cam followers 50 of jaws 40. It will be appreciated that upward movement of shaft 26 relative to sleeve 32 causes can 58 to engage the inside surface of cam follower 50 to pivot and translate jaws 40 outwardly into engagement with the inner wall of the pipe P with the enlarged diameter portion 56 maintaining the jaws in laterally extended positions as the shaft 26 both rotates and moves axially as explained below.

The sleeve 32 of the gear and grip sections is coupled to the upper end of cutter section 18 and which section 18 includes a cutter sleeve 60 and a bearing 62 rotatably coupled to the lower end of sleeve 32 whereby the cutter sleeve 60 is rotatable relative to sleeve 32. Bearing 62 includes an axially split element externally threaded at its lower end for connection with the internal threads of the upper end of cutter sleeve 60. Bearing 62 is internally grooved for rotatable engagement with a similarly grooved lower end portion of sleeve 36 whereby bearing 62 is rotatable relative to sleeve 36 but prevented from axial disengagement therefrom.

Referring to FIG. 4, cutter sleeve 60, immediately below the internally threaded portion thereof which connects with bearing 62, is provided with a hex shaped bore 64 which opens into an enlarged diameter bore 66. Bore 66 extends from the hex shaped bore 64 to the lower end of sleeve 60. With the piston head 24 in a retracted position, a segment of the length of shaft 26 within sleeve 60 is complementarily hex shaped to the hex shaped bore 64, the hex shaped shaft segment being designated 68 and extending downwardly from the upper end of sleeve 60 to a location just above cutter blades 70. It will be appreciated that with the foregoing described construction, shaft 26 is thus splined to cutter sleeve 60 and sleeve 60 is therefore rotatable with shaft 26.

Intermediate the ends of sleeve 60 there are provided a plurality of elongated circumferentially spaced slots 72 opening through the wall of sleeve 60. A cutting blade 70 is disposed in each of the slots 72 and particularly each cutting blade 70 comprises an elongated bracket pivoted about a pin 74 secured to sleeve 60 at one end of the corresponding slot 72. Each bracket is generally L-shaped and has one leg which projects inwardly to define a cam surface or follower 76 along its inner edge. A cutting edge 78 is provided at the lower end of each bracket. Each bracket is thus pivotal between a position retracted within sleeve 60 as illustrated in FIG. 11 wherein the bracket and cutting edge are located within the cylindrical confines of the cutter and an extended position wherein the cutting edges 78 engage the wall of pipe casing P and cut the same in response to rotation of shaft 26 as set forth below. In order to displace the cutting blades 70 into a radially extended position and into cutting engagement with the wall of pipe casing P, the lower end of shaft 26 below the hex shaped segment 68 is provided with risers 80 which taper radially outwardly toward the lower end of shaft 26. The outer surfaces 82 of risers 80 engage cam followers 76 on the cutting brackets 70 to cam the latter outwardly in response to axial upward movement of shaft 26 relative to cutting sleeve 60. Suitable springs, not shown, may be utilized to bias the cutter blades for movement toward their retracted positions.

In operation, pipe cutter 10 is lowered by cable 22 into the well bore and located at a depth such that the cutting edges 78 are disposed at the location of the desired cut. Once located, the pipe cutter is actuated to automatically and substantially simultaneously to extend jaws 40 to grip the pipe casing walls and thereby hold the pipe cutter in position at the desired depth and against rotation, to extend the cutting blades into engagement with the pipe casing and rotate the cutter section such that the cutting edges cut the pipe. Preferably, an expanding gas charge is introduced into cylinder 12 below piston head 24 causing initial relative axial displacement of shaft 26 and the annular outer elements of the pipe cutter. For example, a power charge 90 and cap 92 can be disposed below the piston 24 with a wire 94 connected to a terminal 96 on the cylindrical wall section 12. An insulated electrical wire 98 may be run along the outside of wall 12 and electrically connected at its lower end to terminal 96. The cap 92 is then fired upon closing an electrical switch, not shown, above ground, thereby actuating the power charge 90.

Relative initial axial displacement of the shaft and pipe cutter sections causes cam surface 58 on shaft 26 and the cam followers 50 of jaws 40 to cooperate such that jaws 40 are first pivoted outwardly about axis 42 into engagement with the pipe wall. Once engaged, the enlarged diameter portion 56 on shaft 26 engages cam followers 50 to displace the lower ends of the jaws outwardly such that the surfaces 44 lie flush against the pipe casing walls throughout their lengths whereby the grip section and the sections of the pipe cutter rigidly attached thereto including the gear and cylinder sections are rigidly attached to the pipe wall against axial and rotational displacement.

Initial relative axial displacement of the shaft 26 and the gear, grip and cutter sections causes the risers 80 to cam against the cam followers 76 on the cutting brackets causing laterally outward displacement of the cutting edges toward and into engagement with the interior wall of pipe casing P. Once the gear section is fixed against rotation by the engagement of the jaws 40 against the pipe casing wall, shaft 26 rotates relative to the gear and grip sections upon continued axial displacement of the piston and cylinder by virtue of its geared connection with gear section 14. Rotation of shaft 26 also causes rotation of cutting sleeve 60 through its splined connection with shaft 26 whereby the shaft 26 including risers 80 as well as the cutting edges 78 rotate in unison. Consequently, as shaft 26 is displaced axially upwardly due to the screw or gear type action between it and the gear sleeve 32, the cutting edges not only rotate to cut the pipe internally but are also continuously urged further radially outwardly such that the blades cut through the pipe.

When shaft 26 is displaced axially upwardly a distance equal to the length of enlarged diameter portion 56, the reduced diameter portion of shaft 26 below shaft portion 56 lies in lateral registry with the cams 50 of jaws 40. This releases the engagement of jaws 40 against the pipe wall enabling the jaws to return the their retracted positions within the cylindrical confines of the pipe cutter. Since risers 80 at the lower end of shaft 26 substantially correspond in length to the length of the enlarged diameter section 54 of the shaft 26 the lower end of shaft 26 clears the inner cam followers 76 of the cutting brackets 70 at substantially the same time that the jaws 40 are released from engagement with the pipe casing P. Thus, jaws 40 as well as the cutting brackets 70 are substantially simultaneously permitted to retract within the confines of the pipe cutter. Thus, the pipe cutter can be hauled out of the well bore or lowered therein simply by hauling in or paying out cable 22.

The power charge used to extend the piston in cylinder 12 may be of the type manufactured by Baker Oil Tools, Inc., Model K-2, Wire Line Setting Tools Unit No. 1891. Alternatively, a vacuum can be introduced into cylinder 12 above the piston head by suitable known equipment with like results as previously described. Also, a frangible plug may be located in the wall of cylinder 12 below the piston head and which plug will shatter when sufficient external pressure is applied. Thus, well fluid can be forced through the opening into the cylinder below the piston head with sufficient pressure to cause axial displacement of shaft 26 and to achieve the foregoing described results. It will also be appreciated that the relative orientation of the cutter in the well bore can be reversed with the shaft 26 movable downwardly once the cutter is fixed to the pipe casing and that such reversal causes like operation of the pipe cutter and achieves similar results as previously described.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. A method for cutting a pipe internally comprising: providing a pipe cutter including an elongated sleeve having a lower, rotatable section and an upper, enclosed, cylinder section housing a piston, said sleeve carrying movable gripping jaws at the central portion thereof, and a cutting tool at the lower rotatable section, said sleeve also carrying a shaft axially movable therein, the upper end thereof coupled to said piston;

disposing said pipe cutter within a pipe to be cut;

displacing said shaft in an axial direction relative to said sleeve by displacing said piston within said cylinder;

displacing said gripping jaws and said cutting tool outwardly laterally in response to axial movement of said shaft to grip the interior pipe wall and engage said wall, respectively, as said piston is displaced within said cylinder; and rotating the lower section of said sleeve and said cutting tool relative to the upper portion of said sleeve in response to axial displacement of said shaft to cut said pipe.

2. A method according to claim 1 including continuously displacing said cutting tool laterally outwardly in response to continued axial displacement of said shaft in said one direction.

3. A method according to claim 1 wherein the steps of displacing said gripping jaws and displacing said cutting tool are effected in response to axial displacement of said shaft in one direction and on the same stroke of said piston.

4. The method according to claim 1 including retracting said jaws and cutting tool, laterally, inwardly, in response to continued axial movement of said shaft.

5. A method for cutting a pipe internally utilizing a pipe cutter including an elongated sleeve carrying gripping jaws and a cutting tool and a shaft axially movable within said sleeve comprising the steps of:

disposing said pipe cutter within the pipe to be cut;

displacing said shaft in one axial direction relative to said sleeve;

displacing said jaws laterally outwardly in response to axial movement of said shaft in said one direction to grip the interior pipe wall;

displacing said cutting tool laterally outwardly in response to axial movement of said shaft in said one direction to engage the interior wall of said pipe;

rotating said cutting tool about said axis in response to axial displacement of said shaft in said one axial direction to cut the pipe; and retracting said jaws and said cutting tool laterally, inwardly, in response to continued displacement of said shaft in said one axial direction.

6. The method of claim 5 including continuously displacing said cutting tool laterally outwardly in response to continued axial displacement of said shaft in said one direction until said pipe is cut.

7. The method of claim 5 wherein the steps of displacing said jaws and displacing said cutting tool are effected in response to axial displacement of said shaft in said one direction and on the same stroke thereof.

* * * * *